US011617928B2

(12) United States Patent
Müller

(10) Patent No.: US 11,617,928 B2
(45) Date of Patent: Apr. 4, 2023

(54) PUTTER HEAD AND PUTTER INCLUDING SUCH A PUTTER HEAD

(71) Applicant: Danish Golf Design ApS, Roskilde (DK)

(72) Inventor: Søren Müller, Roskilde (DK)

(73) Assignee: DANISH GOLF DESIGN APS, Roskilde (DK)

( * ) Notice: Subject to any disclaimer, the term of this patent is extended or adjusted under 35 U.S.C. 154(b) by 0 days.

(21) Appl. No.: 17/462,356

(22) Filed: Aug. 31, 2021

(65) Prior Publication Data

US 2022/0001253 A1 Jan. 6, 2022

(51) Int. Cl.
*A63B 53/08* (2015.01)
*A63B 53/02* (2015.01)
*A63B 53/04* (2015.01)

(52) U.S. Cl.
CPC ..... *A63B 53/08* (2013.01); *A63B 53/028* (2020.08); *A63B 53/0487* (2013.01); *A63B 2053/0491* (2013.01)

(58) Field of Classification Search
CPC ... A63B 53/08; A63B 53/028; A63B 53/0487; A63B 53/007; A63B 53/065; A63B 2053/0491; A63B 53/023; A63B 53/025; A63B 53/026; A63B 53/027
USPC ..... 473/244–248, 305–315, 341; D21/736–746
See application file for complete search history.

(56) References Cited

U.S. PATENT DOCUMENTS 1,610,802 A * 12/1926 McNair ..... A63B 60/52 D21/734
2,155,830 A * 4/1939 Howard ..... A63B 60/52 473/246
2,530,446 A * 11/1950 Beardsley ..... A63B 53/0487 D21/738
2,932,515 A * 4/1960 May ..... F16B 5/06 473/248
3,392,977 A * 7/1968 DeLacey ..... A63B 53/007 473/306
3,397,888 A * 8/1968 Springer ..... A63B 53/007 473/248
4,979,744 A * 12/1990 Alcala ..... A63B 60/00 473/341

(Continued)

OTHER PUBLICATIONS

Golfbladet, Free monthly golf magazine from Denmark;, p. 24, Article titled "Dansk putter godkendt af R&A", with english translation attached; Sep. 3, 2020 (Year: 2020).*

*Primary Examiner* — Sebastiano Passaniti

(74) *Attorney, Agent, or Firm* — Nath, Goldberg & Meyer; Jerald L. Meyer; Morgan D. Rosenberg

(57) ABSTRACT

A putter head includes a forwardly facing putting face extending in a longitudinal direction between a heel end and a toe end, and the putter head includes a front part and a rear part. The front part includes: a forward-facing surface including the putting face and a slot provided in an upwardly facing surface of the front part. The slot is configured to take up a hosel for connecting a shaft to the putter head and to arrange the hosel at different longitudinal positions between the heel end and toe end of the putter head. The slot includes a bottom surface, and a rearward-facing surface. The rear part includes an upward-facing surface having connecting means for connecting one or more weights to the rear part of the putter head at different longitudinal positions between the heel end and toe end of the putter head.

21 Claims, 8 Drawing Sheets

(56) References Cited

U.S. PATENT DOCUMENTS 5,308,067 A * 5/1994 Cook ..... A63B 53/0487 473/341
5,351,963 A * 10/1994 Baek ..... A63B 53/0487 473/251
5,390,919 A * 2/1995 Stubbs ..... A63B 53/065 473/292
D360,008 S * 7/1995 Solheim ..... D21/738
5,441,274 A * 8/1995 Clay ..... A63B 53/065 473/246
5,533,725 A * 7/1996 Reynolds, Jr. ..... A63B 53/065 473/307
5,533,730 A * 7/1996 Ruvang ..... A63B 60/00 473/307
D372,752 S * 8/1996 Raudman ..... D21/744
D398,353 S * 9/1998 Wooten ..... D21/742
5,863,257 A * 1/1999 Busnardo ..... A63B 53/065 473/307
6,270,422 B1 * 8/2001 Fisher ..... A63B 53/0487 473/226
D592,715 S * 5/2009 Takei ..... D21/736
8,025,586 B2 * 9/2011 Teramoto ..... A63B 60/42 473/223
8,206,234 B1 * 6/2012 Slater ..... A63B 53/04 473/340
9,108,092 B1 * 8/2015 Warner ..... A63B 53/06
9,844,707 B2 * 12/2017 Davis ..... A63B 53/02
9,956,463 B2 * 5/2018 Franklin ..... A63B 60/54
10,881,928 B2 * 1/2021 Morelock ..... A63B 53/007
11,141,636 B1 * 10/2021 Dixon ..... A63B 53/0416
2002/0198060 A1 * 12/2002 Fisher ..... A63B 60/00 473/244
2003/0027659 A1 * 2/2003 Brown ..... A63B 53/0487 473/329
2005/0227780 A1 10/2005 Cover et al.
2007/0129163 A1 * 6/2007 Solari ..... A63B 60/02 473/340
2013/0178307 A1 7/2013 Wicketts
2015/0045137 A1 * 2/2015 Esposito ..... A63B 53/04 473/307
2018/0185709 A1 * 7/2018 Myers ..... A63B 53/02

* cited by examiner

PUTTER HEAD AND PUTTER INCLUDING SUCH A PUTTER HEAD

FIELD OF THE INVENTION

The invention relates to a putter head, a putter comprising such a putter head, and a kit of parts comprising such a putter head.

BACKGROUND OF THE INVENTION

Putters for golf comes in many types and variations. In general, there are two balance types of putters on the market, namely face-balanced putters and toe-balanced putters. If you take a putter and place it lengthwise on a finger with the shaft parallel to the ground and the putting face (or clubface) is flat and facing straight up, then the putter is face-balanced. On the other hand, if the toe of the putter is pointing downwards so that the putting face is not facing directly upwards, then the putter is toe-balanced.

Putters that are face-balanced open and close less during the putting stroke than a toe-balanced putter. Accordingly, face-balanced putters are best-suited for golfers who use a straight back-and-through putting stroke. On the other hand, face-balanced putters in most instances is a poor choice for a golfer who uses a slightly or strongly arcing putting stroke. Such a golfer does want a clubface that opens and closes during the stroke and should look for a toe-balanced putter. The degree of toe-balancing should accommodate the golfer's natural putting arc. In rear occasions, the putter may have a problematic natural putting stroke, in which case the balancing of the putter may be configured to counteract the unwanted tendencies in the natural putting stroke.

In principle, a face-balanced putter can be achieved in several ways. The simplest way is to have a symmetric putter head design and have the shaft or hosel of the putter configured such that the putting shaft is directed towards a centre of the putting face. However, many putters also have the shaft arranged so that the shaft points towards a point closer to the heel of the putter. In this case, due to torque, an asymmetric putter head design is needed with additional weight on the heel compared to the toe, in order to achieve a face-balanced putter.

Putters of fitting putters are known in the art, where the position of the shaft may be varied relative to the putter head and/or wherein additional weights may be added to the putter head. However, such designs have not yet gained commercial success due to problems in the design, such as unstable connection points, problematic weight balancing, or the like. In this regard, it should be mentioned that for the purpose of having a golf club approved by the Royal and Ancient or PGA that the putter should have a sturdy design so that the configuration cannot be modified during a round of golf without the use of dedicated tools.

SUMMARY OF THE INVENTION

Accordingly, it is the purpose of this disclosure to provide a putter head, putter, and kit of parts, which improves previous putter designs or ameliorates at least one of the known problems with configurable putters.

In the following, directional terms are used to define the putter. These terms are defined in relation to the use of a putter during a normal putting stance. Thus, "forward" defines the front of the putter or the direction of putting, whereas "rear" defines the part of the putter facing away from the putting direction. "Upward" defines the top of the putter head when the putter is grounded in a normal putting stance. The term "heel" defines the part of the putter head that faces towards the golfer during the normal putting stance, whereas the term "toe" defines the part facing away from the golfer. The term "longitudinal" is defined as the direction between the heel and toe of the putter head.

According to a first aspect, a putter head for a putter is provided. The putter head includes a forwardly facing putting face extending in a longitudinal direction between a heel end and a toe end, wherein the putter head comprises a front part and a rear part. The front part comprises: a forward-facing surface including the putting face, a slot provided in an upwardly facing surface of the front part, wherein the slot is configured to taking up a hosel for connecting a shaft to the putter head and further configured to arrange the hosel at different longitudinal positions between the heel end and toe end of the putter head, wherein the slot comprises a bottom surface. The rear part comprises: an upward-facing surface, which comprises weight connecting means for connecting one or more weights to the rear part of the putter head, wherein the weight connecting means are configured for arranging the one or more weights at different longitudinal positions between the heel end and toe end of the putter head. The putter head further includes hosel connecting means for connecting the hosel to the putter head within the slot.

According to a second aspect, a putter is provided. The putter comprises the putter head according to the first aspect. The putter further comprises a hosel arranged within the slot of the front part of the putter head and connected to the via the hosel connecting means of the putter head. The putter further comprises a putter shaft connected to the hosel, and one or more weights connected to the rear part of the putter head via the weight connecting means.

According to a third aspect, a kit of parts is provided. The kit of parts comprises a putter head according to the first aspect, one or more hosels, one or more putter shafts for connecting to the one or more hosels, and one or more weights for attachment to the rear part of the putter head.

Accordingly, a putter head and putter are provided in which the position of a hosel and/or shaft position can be varied very precisely along the longitudinal direction of the putter head, and where the weight of the putter very precisely can be varied between a significant toe-balanced configuration to a face-balanced configuration and even to a heel-balanced configuration. Thus, the putter is designed with a high degree of customisation both with regards to balancing of the putter head itself and relative to the shaft and can with high precision be configured to accommodate a golfer's natural putting arc. Further, the design of the putter head and attachment parts allows for a very sturdy design, which provides a great balance for the putting stroke and further ensures that the configuration cannot be changed during a golf round without proper tools for changing the configuration.

The rear part is distinct from the front part of the putter head. The rear part preferably extends from the front part of the putter head.

In the following, advantageous embodiments are described, which apply to both the putter head, the putter, and the kit of parts. The embodiments can be combined in any way.

In one embodiment, the hosel connecting means for connecting the hosel to the putter head within the slot is provided in the bottom surface of the slot. Thus, the hosel may be connected within the slot by connecting the hosel to the connecting means of the bottom surface, e.g. via bores in the hosel and threaded bores provided in the bottom surface of the slot.

In one embodiment, the rearward-facing surface comprises the hosel connecting means for connecting the hosel to the putter head within the slot, and the hosel connecting means comprises one or more bores in the rearward-facing surface of the front part of the putter head.

The hosel connecting means may comprise a plurality of bores for inserting a screw for attaching the hosel to the front part of the putter head. The bores may for instance be circular holes. The plurality of bores may be arranged equidistantly along the longitudinal direction of the putter head. The bores may advantageously be arranged so that the shaft, attached to the hosel, may be at least arranged so as to be directed towards a centre position of the putter head. The embodiments provide simple solutions for varying the position and attaching a hosel within the slot of the putter head.

In one advantageous embodiment, the slot comprises corrugated sides. The corrugated design may be configured to fit corresponding corrugated sides of a hosel for connection within the slot. This provides a further mechanical stability to the hosel connection and ensures that it does not change position during use. It also ensures that the hosel may be arranged at specific discrete positions along the longitudinal direction of the putter head.

In another embodiment, the hosel connecting means comprises a longitudinally extending rear slot, e.g. with said plurality of bores arranged within the longitudinally extending rear slot. The rear slot may for instance cover the head of a screw of bolt used for attaching a hosel within the slot via the hosel connecting means by inserting the shank of one or more screws or bolts through one or more of said holes. However, it is also possible to have the one or more screws or bolts being inserted in a slit or slot in the rearward-facing surface, whereby the position of the hosel within the upward-facing slot may be varied even more precisely.

In yet another embodiment, the weight connecting means comprises one or more bores in the rear part of the putter head. The bore may for instance be provided as a through-going slot in the rear part of the putter head, such that one or more screws or bolts can be inserted from a bottom part of the putter head and used for connecting one or more weights to the rear part of the putter head, e.g. via threaded bores in the one or more weights.

In one advantageous embodiment, the weight connecting means comprises a plurality of threaded bores. Thereby, the weights may be connected to the rear part, e.g. via screws inserted through a bore through a weight. The bores or threaded bores may be arranged equidistantly in the longitudinal direction of the putter head. Both the solution with the slot and the plurality of bores provides for a simple solution for attaching one or more weights on the rear part of the putter head, whereby the balance of the putter head can be configured according to a desired configuration.

In another embodiment, the rear part comprises a protruding part extending along the longitudinal direction of the putter head. The protruding part may for instance have a rectangular cross section. The weight connecting means may advantageously be provided in the protruding part. This provides a further mechanical stability to the connection to weights having a corresponding recess formed in a lower surface, which further ensures that the weights do not change position or rotate during use of the putter head on a putter. In an alternative embodiment, the protruding part extends to the rearmost part of the putter so that only a recess is formed in the frontmost part of the rear part of the putter head.

The heel end of the putter head and/or the toe end of the putter head may be rounded. Thereby, it is ensured that the ends of the putter are not readily used as a putting stroke surface.

The putter may comprise alignments means for aligning the putter, e.g. in form of aiming line perpendicular to the putting face. The alignment means may be provided in any of the upward-facing part of the front part of the putter, within the slot of the front part of the putter head, and the rear part of the putter head.

In one advantageous embodiment, the one or more weights comprises a recess formed in a lower surface for fitting to a protrusion formed in the rear part of the putter head. This provides further mechanical stability to a connection between weights connected to the rear part of the putter head.

In one highly advantageous embodiment, the one or more weights comprises a front-facing surface which abuts the rear surface of the front part of the putter head. In other words, when the one or more weights are attached to the rear part of the putter, they have a boundary towards the front part of the putter head. This ensures that the centre of mass may be moved close to the putting face.

In one embodiment, the one or more weights are formed so that a top surface of the one or more weights are substantially flush with the upwardly facing surface of the front part of the putter head. This ensures that the centre of mass is centred behind the putting face.

The one or more weights are advantageously provided with a bore. The bore may be a through-going bore extending between a top surface and a bottom surface of the weights. In this case, the one or more weights may be attached to the rear part of the putter head by inserting a screw or bolt through from the top of the one or more weights and attaching it to a threaded bore in the rear part of the putter head. However, it is also possible to use a threaded bore in the bottom surface of the one or more weights. In this case, the weight can be attached to the rear part of the putter head by inserting a screw or bolt through a bore (e.g. a slot or plurality of holes) from the bottom of the rear part of the putter head.

The one or more weights are advantageously attached to the weight connecting means of the rear part via one or more screws or bolts. In principle it is possible to have a threaded bore in a bottom surface of the one or more weights and connecting the weights to the rear part of the putter head via screws inserted through one or more holes from the bottom side of the rear part of the putter head. However, preferably the weight connecting means of the rear part are provided as threaded bores, and the weights are connected to the threaded bores via one or more screws inserted through a through-going bore in the one or more weights.

The one or more weights may comprise at least a heel weight and a toe weight. The heel weight may comprise a shape at a heel end that is substantially flush with a shape at the heel end of the front part of the putter head. The toe weight may comprise a shape at a toe end that is substantially flush with a shape at the toe end of the front part of the putter head.

In one embodiment, at least one of the one or more weights comprises a straight or planar toe-facing surface and/or a straight or planar heel-facing surface. Both the heel-facing and the toe-facing surface of the weight may be straight. This provides a simple embodiment, where individual weights may substantially abut each other. It is also possible to have three weights, e.g. including a centre weight. Such a centre weight may have two straight or plane surfaces. Two or more centre weights can thus be arranged juxtaposed and may optionally abut each other.

At least one of the one or more weights may be tapered at a rearward-facing part of the one or more weights. Thereby, the centre of weight can be moved towards the putting face of the putter head.

In one embodiment, the hosel is provided with at least one bore, and wherein the hosel is attached in the slot via the at least one bore to at least one threaded bore in the bottom surface of the slot. Thus, a screw can be inserted through the bore and be connected in a threaded bore in the bottom surface of the slot, thus connecting the hosel within the slot of the putter head.

In one embodiment, the hosel is provided with at least one threaded bore in a rearward-facing surface of the hosel, wherein the hosel is attached in the slot via at least one screw attached through a hole in the rear surface of the front part of the putter head. The hosel may advantageously be provided with at least a first threaded bore at a heel end of the hosel and a second threaded bore at a toe end of the hosel, wherein the hosel is attached in the slot via at least a first screw and a second screw attached through at least one hole in the rear surface of the front part of the putter head. This provides for a rigid attachment of the hosel within the slot of the front part of the putter head.

The aforementioned screws or bolts may advantageously be configured so that they can be tightened via a hex key or the like.

In one embodiment, the shaft is attached to the hosel in a bore in the hosel.

In one advantageous embodiment, the hosel comprises corrugated sides for fitting to corrugated sides of the slot. This provides additional stability to the connection and further ensures that the hosel cannot change position, once connected to putter head.

The front part may have a height lying in the interval 22-30 mm, advantageously in the interval 24-28 mm, e.g. around 26 mm. The front part may have a width (distance between putting face and rear surface) lying in the interval 15-25 mm, advantageously in the interval 17.5-22.5 mm, e.g. around 20 mm. The rear part may have a width lying in the interval 13-23 mm, advantageously in the interval 15-21 mm, e.g. around 18 mm. A front wall of the front part may have a thickness of between 1.5 and 2.5 mm, advantageously in the interval 1.75-2.25 mm, e.g. around 2.0 mm.

A thickness of a rear wall of the front part may lie in an interval between 4 and 8 mm, advantageously in the interval 5-7 mm, e.g. around 6 mm. The depth of the rear slit or slot may be around 4 mm, and the bores around 2 mm. The rear part may have a height lying in the interval 4-10 mm, advantageously in the interval 6-9 mm, e.g. around 8 mm. A height of the one or more weights may lie in the interval 13-23 mm, advantageously in the interval 15-21 mm, e.g. around 18 mm.

A width (distance between heel end and toe end) of the one or more weights may lie in the interval 16.5-26.5 mm, advantageously in the interval 19-24 mm, e.g. around 21.5 mm. A length (extent in a direction away from the putting face) of the one or more weights is may lie in the interval 15-40 mm, advantageously in the interval 20-40 mm, e.g. around 33.5 mm.

A loft of the putting face may be between 0 and 5 degrees, advantageously between 2 and 4.5 degrees, e.g. around 3.5 degrees.

It is recognised that the kit of parts may comprise one or more different types of hosels, and/or one or more types of putter shafts, and/or one more types of weights. The hosel may for instance be straight, have one or more bends or kinks.

BRIEF DESCRIPTION OF THE FIGURES

The invention is explained in detail below with reference to embodiments shown in the drawings, in which.

DETAILED DESCRIPTION OF THE INVENTION

Figure 1B:
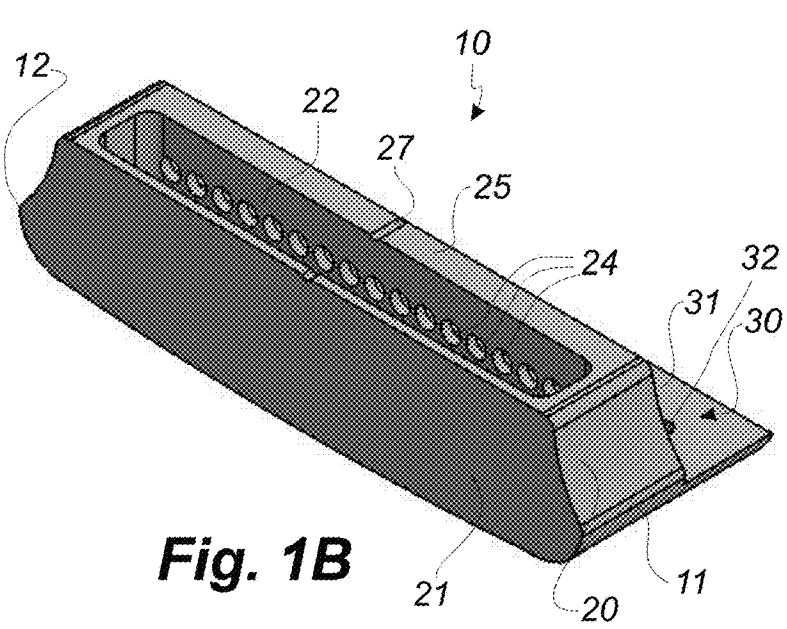
FIGS. 1*a*-1*d* illustrate a first embodiment of a putter head.
Figure 1A:
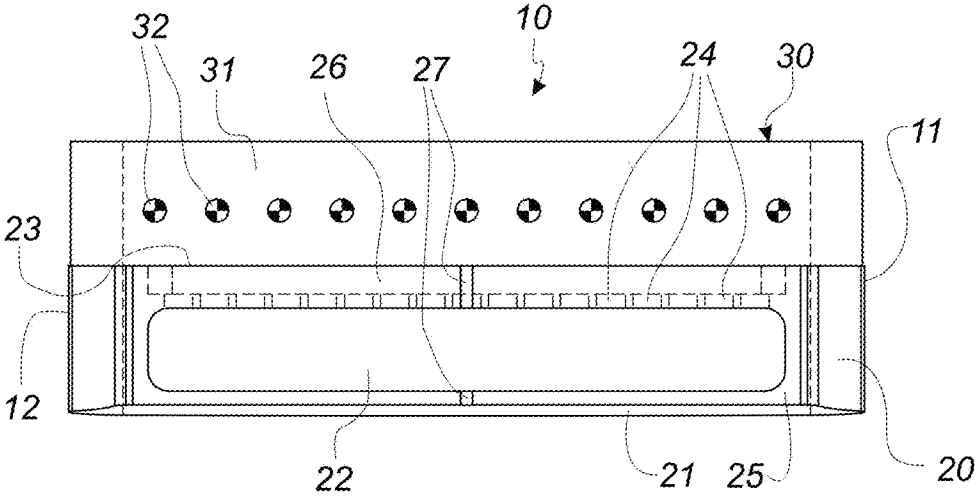

In the following figure description, the same reference numbers refer to the same elements and may thus not be described in relation to all figures.

FIGS. 1A, 1B, 1C, and 1D show a top view, perspective view, a side view, and an end view of a first embodiment of a putter head 10, respectively. The putter head 10 comprises a forwardly facing putting face 21, which is the surface that impact a golf ball in a putting swing. The forwardly facing putting face 21 extends in a longitudinal direction between a heel end 11 and a toe end 12. The putter head 10 further comprises a front part 20 and a rear part 30. The front part 20 of the putter head 10 comprises a forward-facing surface including the putting face 21, a slot 22, and a rearward-facing surface 23. The slot 22 is provided in an upwardly facing surface of the front part 20. The slot 22 is configured to taking up a hosel 40 (not shown in this FIGS. 1*a*-1*d*) for connecting a shaft (also not shown in FIGS. 1*a*-1*d*) to the putter head 10 and is further configured to arrange and secure the hosel 40 at different longitudinal positions between the heel end 11 and toe end of the putter head 10. The slot 22 comprises a bottom surface.

The rear part 30 comprises an upward-facing surface 31, which comprises weight connecting means 32 for connecting one or more weights 50, 60 to the rear part 30 of the putter head. The weight connecting means 32 are configured to arranging the one or more weights 50, 60 at different longitudinal positions between the heel end 11 and toe end of the putter head 10.

The putter head further includes hosel connecting means 24, 26 for connecting the hosel to the putter head within the slot 22.

In the shown embodiment, the hosel connecting means for connecting the hosel to the putter head 10 within the slot 22 are formed in the rearward-facing surface 23. The hosel connecting means comprises a plurality of bores 24 in the rearward-facing surface 23 of the front part 20 of the putter head 10. In the shown embodiment, the hosel connecting means further comprises a longitudinally extending rear slot 26 formed in the rearward-facing surface 23 with said plurality of bores 24 arranged within the longitudinally extending rear slot. Screws can be inserted through the bores 24 in order to attach a hosel 40 within the slot 22 of the front part 20. The head of the screws may be arranged within the slot 26 so that they do not extend from the rearward-facing surface 23 of the front part 22.

The weight connecting means are provided as a plurality of threaded bores 32 formed in the rear part 30 of the putter head 10, by which weights can be attached to the rear part 30 of the putter head 10. The threaded bores 32 are in the shown embodiment arranged equidistantly in the longitudinal direction of the putter head 10.

Figure 1C:
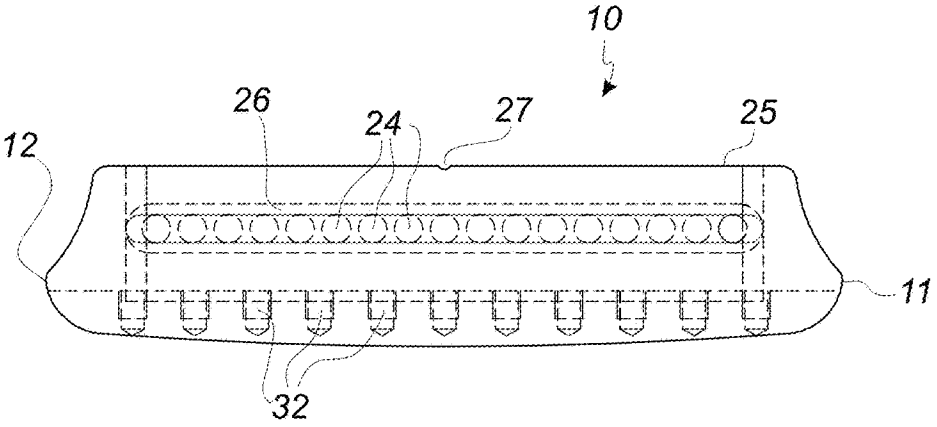
Figure 1D:
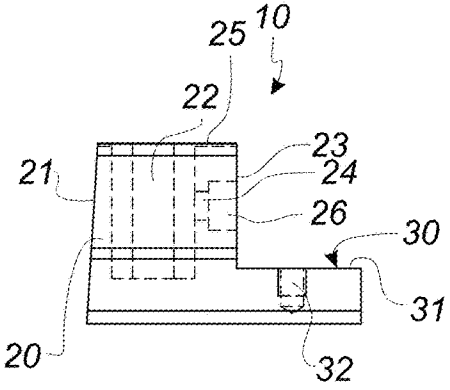
Figure 2A:
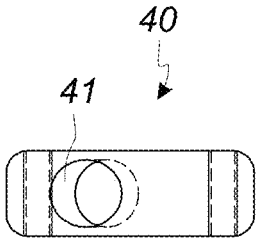
FIGS. 2*a*-2*d* illustrate a first embodiment of hosel for connecting a shaft to a putter head.
Figure 2B:
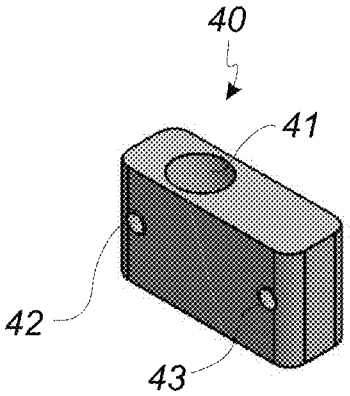
Figure 2C:
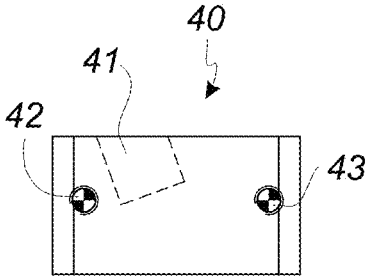
Figure 2D:
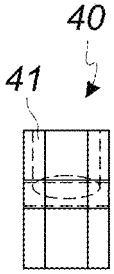
Figure 3A:
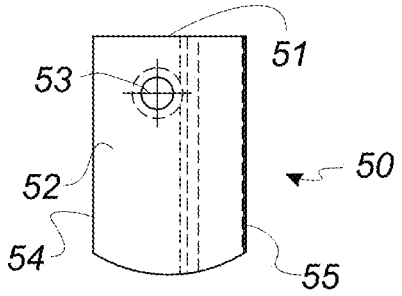
FIGS. 3*a*-3*d* illustrate a first heel weight for a putter head.
Figure 3B:
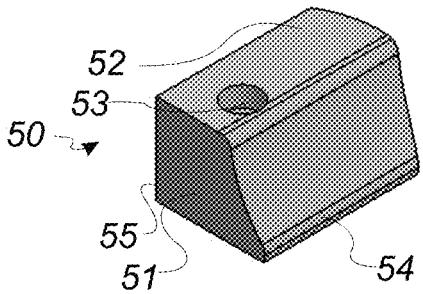
Figure 3C:
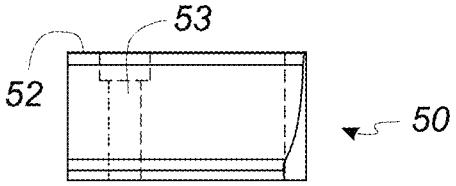
Figure 3D:
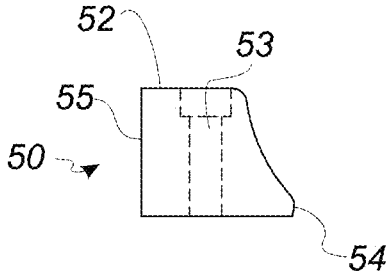
Figure 4A:
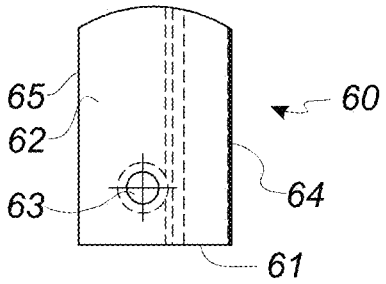
FIGS. 4*a*-4*d* illustrate a first toe weight for a putter head, FIG. 5 illustrate a first assembled putter head and putter.
Figure 4B:
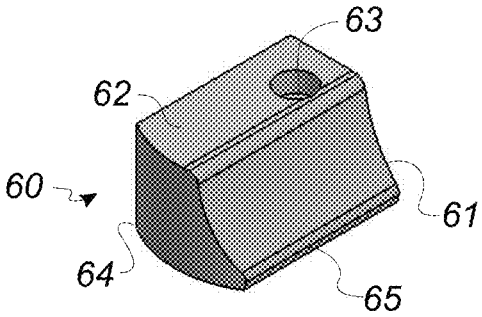
Figure 4C:
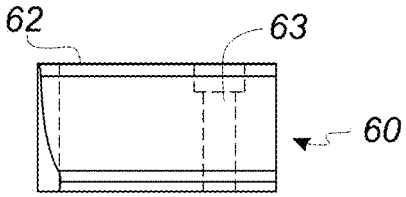
Figure 4D:
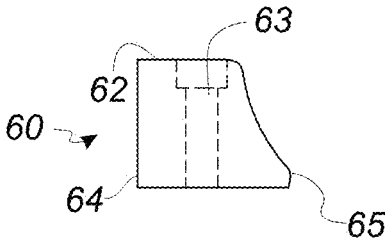

As can be seen in particular in FIGS. 1B and 1C, the heel end 11 of the putter head 10 is rounded, and the toe end 12 of the putter head 10 is rounded as well.

In addition, the putter head 10 comprises alignments means 27 for aligning the putter in form of aiming line perpendicular to the putting face. The aiming line is formed as a notch in the top surface of the front part 20 of the putter head. The aiming line may be painted in order to make the aiming line more visible.

FIGS. 2A, 2B, 2C, and 2D show a top view, perspective view, a side view, and an end view of a first embodiment of a hosel 40, respectively. The hosel 40 comprises a bore 41 for attaching a putter shaft to the hosel 40. The hosel is further provided with a first threaded bore 42 and second threaded bore 43 via which the hosel 40 can be attached within the slot 22 of the front part 20 of the putter head via screws inserted through the bores 24 formed in the rear-facing surface 23 of the front part 22 of the putter head. In the shown embodiment, the hosel 40 is provided with two threaded bores, but one may be sufficient. However, two threaded bores may provide mechanical stability to the connection within the slot 22.

FIGS. 3A, 3B, 3C, and 3D show a top view, perspective view, a side view, and an end view of a first heel weight 50, respectively. The first heel weight 50 comprises a front facing surface 51, which when connected to the rear part 30 of the putter head 10 faces towards the rear surface 23 of the front part 20. The first heel weight 50 further comprises a top surface 52, a heel end or heel facing side 54, and a toe end or toe facing side 55. In addition, the first heel weight 50 comprises a bore 53 extending through the first heel weight 50 from the top surface 52 to a bottom surface.

The first heel weight 50 may advantageously be formed and dimensioned so that the top surface 52 is substantially flush with the upwardly facing surface 25 of the front part 20 of the putter head 10, when it is mounted on the rear part 23 of the putter head 10.

The first heel weight 50 may be attached to the weight connecting means 32 of the rear part 30 via one or more screws inserted through the bore 53 and connected to the threaded bores 32 in the rear part 30 of the putter head.

In the shown embodiment, the first heel weight 50 comprises a shape at the heel end 54 that is substantially flush with the shape at the heel end 11 of the front part 20 of the putter head 10. Further, the toe end 55 of the first heel weight 50 has a straight or planar surface. Thereby, other weights with straight end sides may readily be arranged juxtaposed to the first heel weight 50. The first heel weight 50 may also as shown be tapered at a rearward-facing part of the first heel weight.

FIGS. 4A, 4B, 4C, and 4D show a top view, perspective view, a side view, and an end view of a first toe weight 60, respectively. The first toe weight 60 comprises a front facing surface 61, which when connected to the rear part 30 of the putter head 10 faces towards the rear surface 23 of the front part 20. The first toe weight 60 further comprises a top surface 62, a heel end or heel facing side 64, and a toe end or toe facing side 65. In addition, the first toe weight 60 comprises a bore 63 extending through the first toe weight 60 from the top surface 62 to a bottom surface.

The first toe weight 60 may advantageously be formed and dimensioned so that the top surface 52 is substantially flush with the upwardly facing surface 25 of the front part 20 of the putter head 10, when it is mounted on the rear part 23 of the putter head 10.

The first toe weight 60 may be attached to the weight connecting means 32 of the rear part 30 via one or more screws inserted through the bore 63 and connected to the threaded bores 32 in the rear part 30 of the putter head.

In the shown embodiment, the first toe weight 60 comprises a shape at the toe end 65 that is substantially flush with the shape at the toe end 12 of the front part 20 of the putter head 10. Further, the heel end 64 of the first toe weight 60 has a straight or planar surface. Thereby, other weights with straight end sides may readily be arranged juxtaposed to the first toe weight 60. The first heel weight 60 may also as shown be tapered at a rearward-facing part of the first heel weight.

Figure 5:
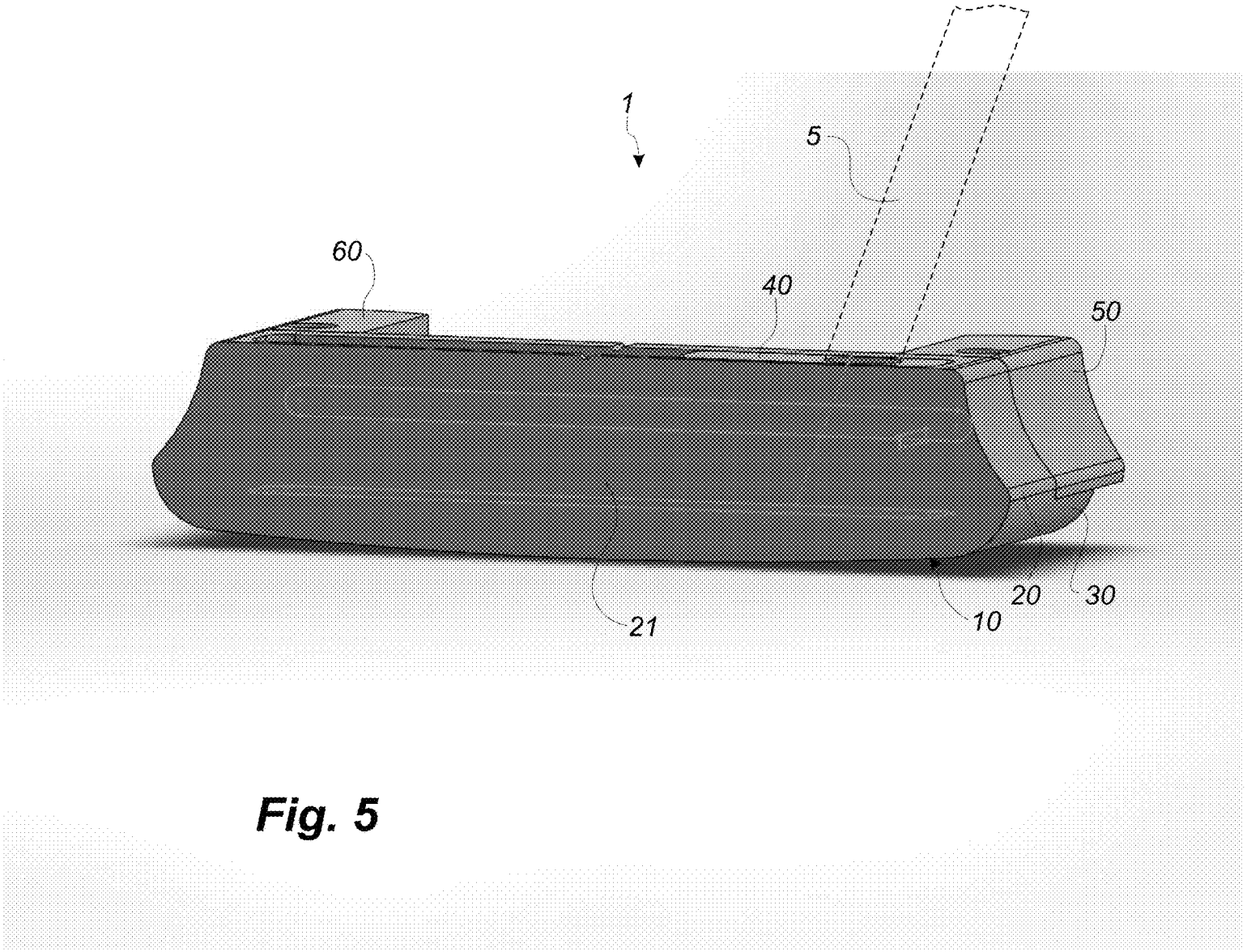

FIG. 5 shows a perspective view of a first assembled putter head and putter 1. The putter 1 comprises the putter head 10, a hosel arranged within the slot 22 of the front part 20 of the putter head, the hosel 40 being connected within the slot 22 via the hosel connecting means 24. A putter shaft 5 is connected to the hosel 40. Further, the first heel weight 50 and the first toe weight 60 are connected to the rear part 30 of the putter head 10 via the weight connecting means 32. The front-facing surfaces of the first heel weight 50 and the first toe weight 60 abut the rear surface 23 of the front part 20 of the putter head 10.

In the shown embodiment, the first heel weight 50 is arranged outermost towards the heel 11 of the putter head 10, and the first toe weight 60 is arranged outermost towards the toe 12 of the putter head 10. However, it is recognised that the weights may be placed anywhere along the rear part 30 of the putter head 10. It is also recognised that the putter head may be fitted with no weight, one weight, two weights, three weights, or even four or more weights. Further, the hosel 40 is shown as being connected innermost towards the heel 11 of the putter head 10. However, it is recognised that the hosel 40 may be connected anywhere along the slot 22.

It is also clear that the putter 1 may be assembled from a kit of parts comprising the putter head 10, the hosel 40, a putter shaft 5 for connecting to the hosel, and one or more weights, e.g. the first heel weight 50 and the first toe weight 60, for attachment to the rear part 30 of the putter head 10.

FIGS. 6A, 6B, 6C, and 6D show a top view, perspective view, a side view, and an end view of a second embodiment of a putter head 110, respectively. The putter head 110 comprises a forwardly facing putting face 121, which is the surface that impact a golf ball in a putting swing. The forwardly facing putting face 121 extends in a longitudinal direction between a heel end 111 and a toe end 112. The putter head 110 further comprises a front part 120 and a rear part 130. The front part 120 of the putter head 110 comprises a forward-facing surface including the putting face 121, a slot 122, and a rearward-facing surface 123. The slot 122 is provided in an upwardly facing surface of the front part 120. The slot 122 is configured to taking up a hosel 140 (not shown in this FIGS. 6*a*-6*d*) for connecting a shaft (also not shown in FIGS. 6*a*-6*d*) to the putter head 110 and is further configured to arrange and secure the hosel 140 at different longitudinal positions between the heel end 111 and toe end of the putter head 110. The slot 122 comprises a bottom surface.

The rear part 130 comprises an upward-facing surface 131, which comprises weight connecting means 132 for connecting one or more weights 150, 160 to the rear part 130 of the putter head. The weight connecting means 132 are configured to arranging the one or more weights 150, 160 at different longitudinal positions between the heel end 11 and toe end of the putter head 110.

The putter head further includes hosel connecting means 124 for connecting the hosel to the putter head within the slot.

In the shown embodiment, the hosel connecting means 124 for connecting the hosel to the putter head 110 within the slot 122 are formed in the bottom surface of the slot 122. The hosel connecting means comprises a plurality of threaded bores 124 in the bottom surface of the front part 120 of the putter head 110. The threaded bores 124 may be arranged equidistantly along the slot 122. Screws can be inserted through bores provided in the hosel 140 to attach the hosel 140 within the slot 122 of the front part 120 by connecting the screws to the threaded bores 124. The head of the screws may be arranged within a countersink in the top surface of the hosel 140 so that they do not extend from the top surface of the hosel 140.

The weight connecting means are provided as a plurality of threaded bores 132 formed in the rear part 130 of the putter head 110, by which weights can be attached to the rear part 130 of the putter head 110. The threaded bores 132 are in the shown embodiment arranged equidistantly in the longitudinal direction of the putter head 110. In the shown embodiment, the rear part 130 comprises a protruding part 133 extending along the longitudinal direction of the putter head 110. The protruding part 133 may advantageously comprise a rectangular cross section. Further, the threaded bores 132 may advantageously be provided in the protruding part, which means that the threaded bores may be deeper and the weights 150, 160 can more securely be connected to the rear part 130. In an alternative embodiment, the protruding part extends to the rearmost part of the putter so that only a recess is formed in the frontmost part of the rear part of the putter head. In the alternative embodiment, the weights are not provided with a recess formed in the lower surface but rather have a protruding part, which fits into the recess formed at the frontmost part of the rear part of the putter head.

Figure 6A:
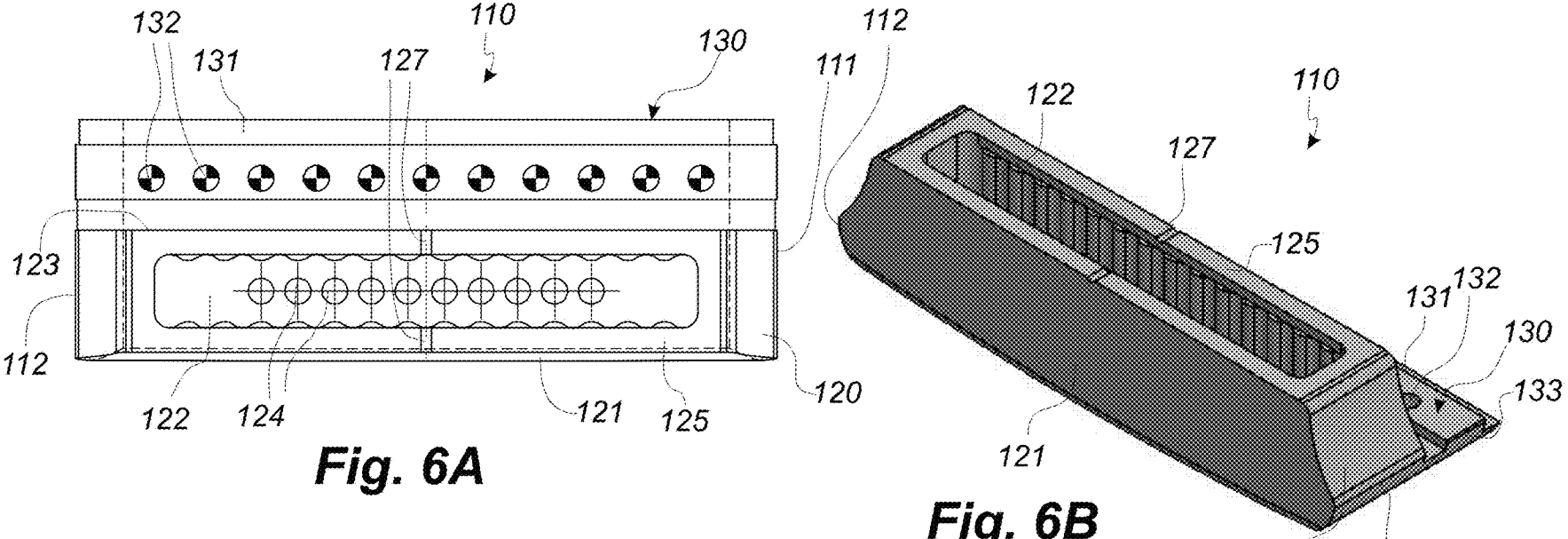
FIGS. 6*a*-6*d* illustrate a second embodiment of a putter head.
Figure 6B:
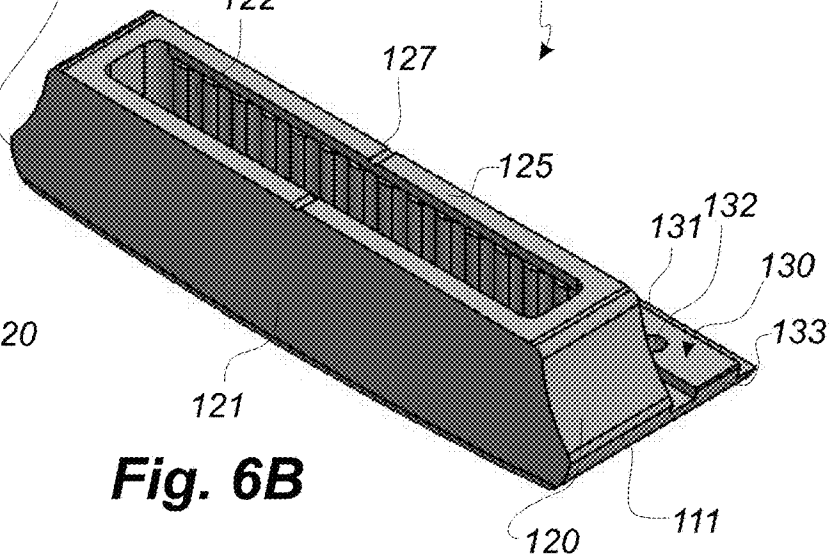
Figure 6C:
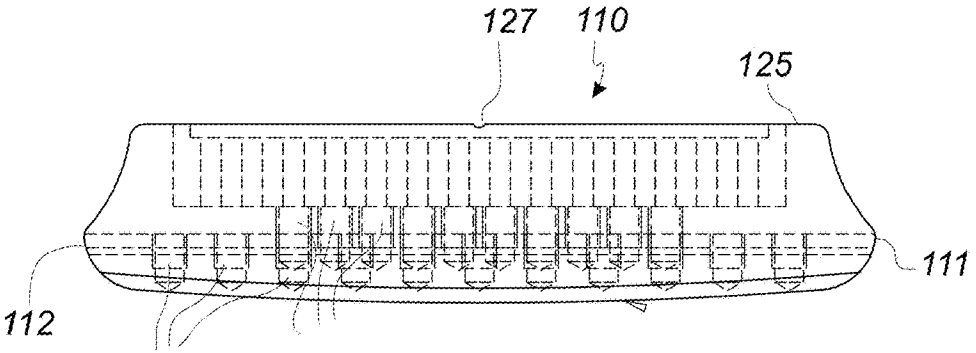
Figure 6D:
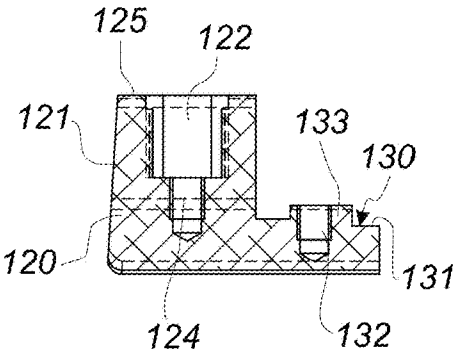
Figure 7A:
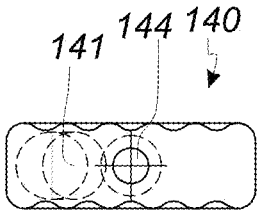
FIGS. 7*a*-7*d* illustrate a second embodiment of hosel for connecting a shaft to a putter head.
Figure 7B:
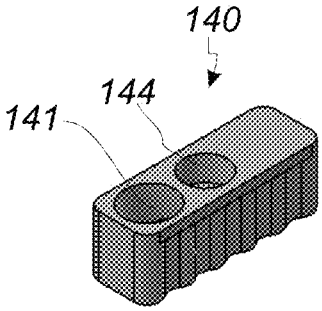
Figure 7C:
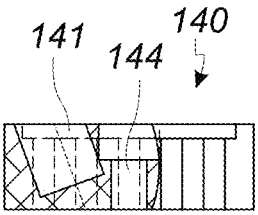
Figure 7D:
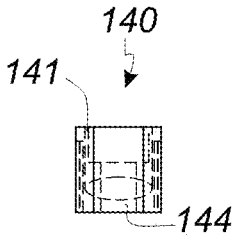
Figure 8A:
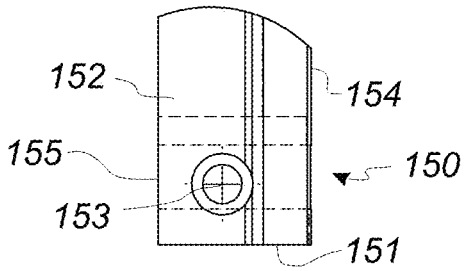
FIGS. 8*a*-8*d* illustrate a second heel weight for a putter head.
Figure 8B:
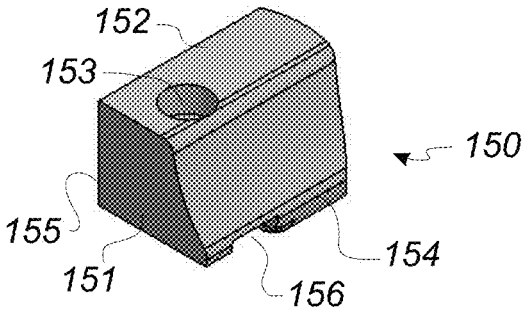
Figure 8C:
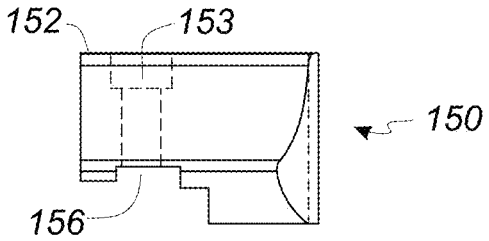
Figure 8D:
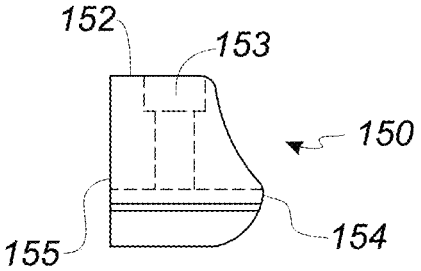
Figure 9A:
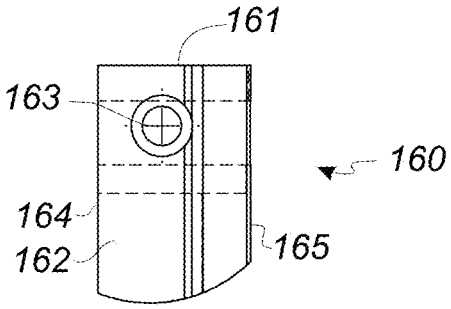
FIGS. 9*a*-9*d* illustrate a second toe weight for a putter head, and FIG. 10 illustrate a second assembled putter head.
Figure 9B:
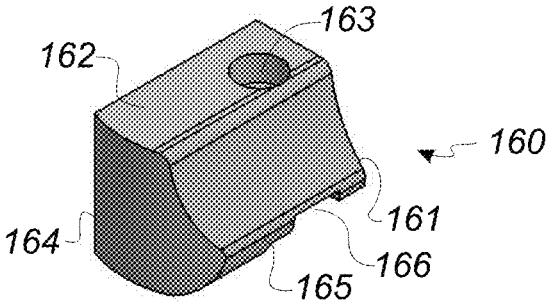
Figure 9C:
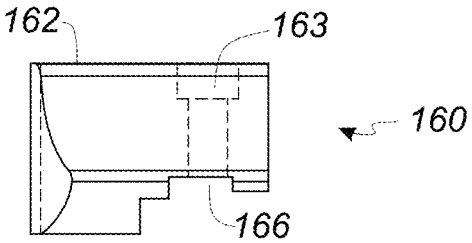
Figure 9D:
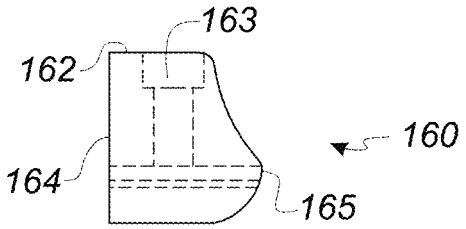

As can be seen in particular in FIGS. 6B and 6C, the heel end 111 of the putter head 10 is rounded, and the toe end 112 of the putter head 110 is rounded as well.

In addition, the putter head 110 comprises alignments means 127 for aligning the putter in form of aiming line perpendicular to the putting face. The aiming line 127 is formed as a notch in the top surface of the front part 210 of the putter head 110. The aiming line 127 may be painted in order to make the aiming line more visible.

Further, in the shown embodiment, the slot 122 comprises corrugated sides. The hosel 140 may be provided with corresponding fitting corrugated sides, which may provide a more stable connection between the hosel 140 and the putter head 110.

FIGS. 7A, 7B, 7C, and 7D show a top view, perspective view, a side view, and an end view of a second embodiment of the hosel 140, respectively. The hosel 40 comprises a bore 141 for attaching a putter shaft to the hosel 140. The hosel 141 is further provided with a bore 144 via which the hosel 140 can be attached within the slot 122 of the front part 120 of the putter head 110 via screws inserted through the bore 144 and connected to the threaded bores 124 in the slot 122.

FIGS. 8A, 8B, 8C, and 8D show a top view, perspective view, a side view, and an end view of a second heel weight 150, respectively. The second heel weight 150 comprises a front facing surface 151, which when connected to the rear part 130 of the putter head 110 faces towards the rear surface 123 of the front part 120. The second heel weight 150 further comprises a top surface 152, a heel end or heel facing side 154, and a toe end or toe facing side 155. In addition, the second heel weight 150 comprises a bore 153 extending through the second heel weight 150 from the top surface 152 to a bottom surface.

The second heel weight 150 may advantageously be formed and dimensioned so that the top surface 152 is substantially flush with the upwardly facing surface 125 of the front part 120 of the putter head 110, when it is mounted on the rear part 123 of the putter head 110.

The second heel weight 150 may be attached to the weight connecting means 132 of the rear part 130 via one or more screws inserted through the bore 153 and connected to the threaded bores 132 in the rear part 130 of the putter head.

In the shown embodiment, the second heel weight 150 comprises a shape at the heel end 154 that is substantially flush with the shape at the heel end 111 of the front part 120 of the putter head 110. Further, the toe end 155 of the second heel weight 150 has a straight or planar surface. Thereby, other weights with straight end sides may readily be arranged juxtaposed to the second heel weight 150. The second heel weight 150 may also as shown be tapered at a rearward-facing part of the second heel weight.

In the shown embodiment, a recess 156 is formed in a lower surface of the second heel weight 150 for fitting to the 133 protrusion formed in the rear part of the putter head 110. This may provide a more stable connection between the second heel weight 150 and the rear part 130 of the putter head 110 and better ensure that the second heel weight 150 cannot rotate in relation to the rear part 130 of the putter head.

FIGS. 9A, 9B, 9C, and 9D show a top view, perspective view, a side view, and an end view of a second toe weight 160, respectively. The second toe weight 160 comprises a front facing surface 161, which when connected to the rear part 130 of the putter head 110 faces towards the rear surface 123 of the front part 120. The second toe weight 160 further comprises a top surface 162, a heel end or heel facing side 164, and a toe end or toe facing side 165. In addition, the second toe weight 160 comprises a bore 163 extending through the second toe weight 160 from the top surface 162 to a bottom surface.

The second toe weight 160 may advantageously be formed and dimensioned so that the top surface 152 is substantially flush with the upwardly facing surface 125 of the front part 120 of the putter head 110, when it is mounted on the rear part 123 of the putter head 110.

The second toe weight 160 may be attached to the weight connecting means 132 of the rear part 130 via one or more screws inserted through the bore 163 and connected to the threaded bores 132 in the rear part 130 of the putter head.

In the shown embodiment, the second toe weight 160 comprises a shape at the toe end 165 that is substantially flush with the shape at the toe end 112 of the front part 120 of the putter head 110. Further, the heel end 164 of the second toe weight 160 has a straight or planar surface. Thereby, other weights with straight end sides may readily be arranged juxtaposed to the second toe weight 160. The second heel weight 60 may also as shown be tapered at a rearward-facing part of the second heel weight.

In the shown embodiment, a recess 166 is formed in a lower surface of the second toe weight 160 for fitting to the 133 protrusion formed in the rear part of the putter head 110. This may provide a more stable connection between the second toe weight 160 and the rear part 130 of the putter head 110 and better ensure that the toe heel weight 160 cannot rotate in relation to the rear part 130 of the putter head.

Figure 10:
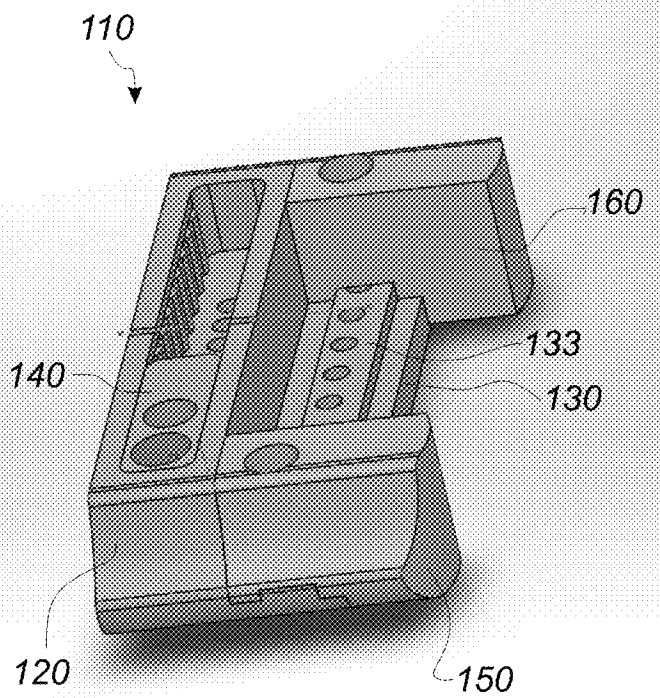

FIG. 10 shows a perspective view of a second assembled putter head 110 and putter. The putter comprises the putter head 110, the hosel 140 arranged within the slot 212 of the front part 120 of the putter head 110, the hosel 140 being connected within the slot 122 via the hosel connecting means 124. A putter shaft (not shown) is connected to the hosel 140. Further, the first heel weight 150 and the first toe weight 160 are connected to the rear part 130 of the putter head 110 via the weight connecting means 132. The front-facing surfaces of the first heel weight 150 and the first toe weight 160 abut the rear surface 123 of the front part 120 of the putter head 110.

In the shown embodiment, the first heel weight 150 is arranged outermost towards the heel 111 of the putter head 110, and the first toe weight 160 is arranged outermost towards the toe 112 of the putter head 110. However, it is recognised that the weights may be placed anywhere along the rear part 130 of the putter head 110. It is also recognised that the putter head may be fitted with no weight, one weight, two weights, three weights, or even four or more weights. Further, the hosel 140 is shown as being connected innermost towards the heel 111 of the putter head 110. However, it is recognised that the hosel 140 may be connected anywhere along the slot 122.

It is also clear that the putter may be assembled from a kit of parts comprising the putter head 110, the hosel 140, a putter shaft for connecting to the hosel, and one or more weights, e.g. the first heel weight 150 and the first toe weight 160, for attachment to the rear part 130 of the putter head 110.

It is recognised that features from the first embodiment shown in FIGS. 1-5 and features from the second embodiment shown in FIGS. 6-10 may be combined in any way. The first embodiment may for instance be provided with corrugated sides in the slot and/or the rear part may be provided with a protrusion for formfitting with a recess in weights. The rear part in the second embodiment may for instance be provided without a protrusion.

Both shown embodiments provide a putter head and putter in which the position of a hosel and/or shaft position can be varied very precisely along the longitudinal direction of the putter head at discrete positions, and where the weight of the putter very precisely can be varied between a significant toe-balanced configuration to a face-balanced configuration and even to a heel-balanced configuration. Thus, the putter is designed with a high degree of customisation both with regards to balancing of the putter head itself and relative to the shaft and can with high precision be configured to accommodate a golfer's natural putting arc. Further, the design of the putter head and attachment parts allows for a very sturdy design, which provides a great balance for the putting stroke.

In the following, advantageous dimensioning of the putter head and weights is described. These apply to both the first and the second embodiment.

The front part may have a height lying in the interval 22-30 mm, advantageously in the interval 24-28 mm, e.g. around 26 mm. The front part may have a width (i.e. the distance between putting face and rear surface) lying in the interval 15-25 mm, advantageously in the interval 17.5-22.5 mm, e.g. around 20 mm. The rear part may have a width lying in the interval 13-23 mm, advantageously in the interval 15-21 mm, e.g. around 18 mm. A front wall of the front part may have a thickness of between 1.5 and 2.5 mm, advantageously in the interval 1.75-2.25 mm, e.g. around 2.0 mm.

A thickness of a rear wall of the front part may lie in an interval between 4 and 8 mm, advantageously in the interval 5-7 mm, e.g. around 6 mm. The depth of the rear slit or slot may be around 4 mm, and the bores around 2 mm. The rear part may have a height lying in the interval 4-10 mm, advantageously in the interval 6-9 mm, e.g. around 8 mm. A height of the one or more weights may lie in the interval 13-23 mm, advantageously in the interval 15-21 mm, e.g. around 18 mm.

A width (distance between heel end and toe end) of the one or more weights may lie in the interval 16.5-26.5 mm, advantageously in the interval 19-24 mm, e.g. around 21.5 mm. A length (extent in a direction away from the putting face) of the one or more weights is may lie in the interval 15-40 mm, advantageously in the interval 20-40 mm, e.g. around 33.5 mm.

A loft of the putting face may be between 0 and 5 degrees, advantageously between 2 and 4.5 degrees, e.g. around 3.5 degrees.

Exemplary embodiments of the putter head, putter, and kit of parts are set out in the following items:

1. A putter head (10, 110) for a putter (1), wherein the putter head (10, 110) includes a forwardly facing putting face (21, 121) extending in a longitudinal direction between a heel end (11, 111) and a toe end (12, 112), wherein the putter head (10, 110) comprises a front part (20, 120), and a rear part (30, 130), wherein the front part (20, 120) comprises:

a forward-facing surface including the putting face (21, 121), a slot (22, 122) provided in an upwardly facing surface of the front part (20, 120), wherein the slot (22, 122) is configured to taking up a hosel (40, 140) for connecting a shaft (5) to the putter head (10, 110) and further configured to arrange the hosel (40, 140) at different longitudinal positions between the heel end (11, 111) and toe end (12, 112) of the putter head (10, 110), wherein the slot (22, 122) comprises a bottom surface, and a rearward-facing surface (23, 123), wherein the rear part (30, 130) comprises:

an upward-facing surface (31, 131), which comprises weight connecting means (32, 132) for connecting one or more weights (50, 150; 60, 160) to the rear part (30, 130) of the putter head (10, 110), wherein the weight connecting means (32, 132) are configured to arranging the one or more weights (50, 150; 60, 160) at different longitudinal positions between the heel end (11, 111) and toe end (12, 112) of the putter head (10, 110), and wherein the putter head further includes hosel connecting means for connecting the hosel to the putter head within the slot (22, 122).

2. The putter head according to item 1, wherein the hosel connecting means for connecting the hosel to the putter head within the slot (22, 122) is provided in the bottom surface of the slot (22, 122).

3. The putter head according to item 1, wherein the rearward-facing surface (23, 123) comprises the hosel connecting means for connecting the hosel to the putter head within the slot (22, 122), and wherein the hosel connecting means comprises one or more bores in the rearward-facing surface (23, 123) of the front part (20, 120) of the putter head (10, 110).

4. The putter head according to any of the preceding items, wherein the hosel connecting means comprises a plurality of bores for inserting a screw for attaching the hosel (40, 140) to the front part (20, 120) of the putter head (10, 110).

5. The putter head according to item 4, wherein the bores of the plurality of bores are arranged equidistantly along the longitudinal direction of the putter head (10, 110).

6. The putter head according to any of items 2-5, wherein the hosel connecting means comprises a longitudinally extending rear slot formed in the rearward-facing surface, e.g. with said plurality of bores arranged within the longitudinally extending rear slot.

7. The putter head according to any of the preceding items, wherein the slot (22, 122) comprises corrugated sides.

8. The putter head according to any of the preceding items, wherein the weight connecting means comprises one or more bores in the rear part (30, 130) of the putter head (10, 110).

9. The putter head according to any of items 1-8, wherein the weight connecting means comprises a plurality of threaded bores.

10. The putter head according to item 8 or 9, wherein the bores or threaded bores are arranged equidistantly in the longitudinal direction of the putter head (10, 110).

11. The putter head according to any of the preceding items, wherein the rear part (30, 130) comprises a protruding part (133) extending along the longitudinal direction of the putter head (10, 110).

12. The putter head according to item 11, wherein the protruding part (133) has a rectangular cross section.

13. The putter head according to item 11 or 12, wherein the weight connecting means (32, 132) are provided in the protruding part (133).

14. The putter head according to any of the preceding items, wherein the heel end of the putter head (10, 110) is rounded.

15. The putter head according to any of the preceding items, wherein the toe end of the putter head (10, 110) is rounded.

16. The putter head according to any of the preceding items, further comprising alignments means for aligning the putter, e.g. in form of aiming line perpendicular to the putting face.

17. A putter (1) comprising:

a putter head (10, 110) according to any of items 1-16, a hosel (40, 140) arranged within the slot (22, 122) of the front part (20, 120) of the putter head (10, 110) and connected to the slot (22, 122) via the hosel connecting means (24), and a putter shaft (5) connected to the hosel (40, 140), one or more weights (50, 150; 60, 160) connected to the rear part (30, 130) of the putter head (10, 110) via the weight connecting means (32, 132).

18. The putter according to item 17, wherein the one or more weights comprises a recess formed in a lower surface for fitting to a protrusion formed in the rear part of the putter head (10, 110).

19. The putter according to item 17 or 18, wherein the one or more weights comprises a front-facing surface which abuts the rear surface (23, 123) of the front part (20, 120) of the putter head (10, 110).

20. The putter according to any of items 17-19, wherein the one or more weights (50, 150; 60, 160) are formed so that a top surface of the one or more weights are substantially flush with the upwardly facing surface (25) of the front part (20, 120) of the putter head (10, 110).

21. The putter according to any of items 17-20, wherein the one or more weights are provided with a bore.

22. The putter according to item 21, wherein the one or more weights are attached to the weight connecting means (32, 132) of the rear part (30, 130) via one or more screws.

23. The putter (1) according to any of item 17-22, wherein the one or more weights comprises at least a heel weight (50, 150) and a toe weight (60, 160).

24. The putter (1) according to item 23, wherein the heel weight (50, 150) comprises a shape at a heel end that is substantially flush with a shape at the heel end (11, 111) of the front part (20, 120) of the putter head (10, 110); and/or the toe weight comprises a shape at a toe end that is substantially flush with a shape at the toe end (12, 112) of the front part (20, 120) of the putter head (10, 110).

25. The putter according to any of items 17-24, wherein at least one of the one or more weights comprises a straight toe-facing surface and/or a straight heel-facing surface.

26. The putter (1) according to any of items 17-25, wherein at least one of the one or more weights are tapered at a rearward-facing part of the one or more weights.

27. The putter (1) according to any of items 17-26, wherein the hosel (40, 140) is provided with at least one bore, and wherein the hosel (40, 140) is attached in the slot (22, 122) via the at least bore to at least one threaded bore in the bottom surface of the slot (22, 122).

28. The putter (1) according to any of items 17-27, wherein the hosel (40, 140) is provided with at least one threaded bore in a rearward-facing surface of the hosel (40, 140), and wherein the hosel (40, 140) is attached in the slot (22, 122) via at least one screw attached through a hole in the rear surface (23, 123) of the front part (20, 120) of the putter head (10, 110).

29. The putter (1) according to item 28, wherein the hosel is provided with at least a first threaded bore at a heel end of the hosel and a second threaded bore at a toe end of the hosel (40, 140), and wherein the hosel (40, 140) is attached in the slot (22, 122) via at least a first screw and a second screw attached through at least one hole in the rear surface (23, 123) of the front part (20, 120) of the putter head (10, 110).

30. The putter (1) according to any of items 17-29, wherein the shaft is attached to the hosel in a bore in the hosel.

31. The putter (1) according to any of items 17-30, wherein the hosel (40, 140) comprises corrugated sides for fitting to corrugated sides of the slot (22, 122).

32. The putter (1) according to any of items 17-31, wherein the front part has a height lying in the interval 22-30 mm, advantageously in the interval 24-28 mm, e.g. around 26 mm.

33. The putter (1) according to any of items 17-32, wherein the front part has a width lying in the interval 15-25 mm, advantageously in the interval 17.5-22.5 mm, e.g. around 20 mm.

34. The putter (1) according to any of items 17-33, wherein the rear part has a width lying in the interval 13-23 mm, advantageously in the interval 15-21 mm, e.g. around 18 mm.

35. The putter (1) according to any of items 17-34, wherein a thickness of a front wall of the front part has a thickness of between 1.5 and 2.5 mm, advantageously in the interval 1.75-2.25 mm, e.g. around 2.0 mm.

36. The putter (1) according to any of items 17-35, wherein a thickness of a rear wall of the front part has a thickness of between 4 and 8 mm, advantageously in the interval 5-7 mm, e.g. around 6 mm.

37. The putter (1) according to any of items 17-36, wherein the rear part has a height lying in the interval 4-10 mm, advantageously in the interval 6-9 mm, e.g. around 8 mm.

38. The putter (1) according to any of items 17-37, wherein a height of the one or more weights is lying in the interval 13-23 mm, advantageously in the interval 15-21 mm, e.g. around 18 mm.

39. The putter (1) according to any of items 17-38, wherein a width of the one or more weights is lying in the interval 16.5-26.5 mm, advantageously in the interval 19-24 mm, e.g. around 21.5 mm.

40. The putter (1) according to any of items 17-39, wherein a width of the one or more weights is lying in the interval 15-40 mm, advantageously in the interval 20-40 mm, e.g. around 33.5 mm.

41. The putter (1) according to any of items 17-40, wherein a loft of the putting surface is between 0 and 5 degrees, advantageously between 2 and 4.5 degrees, e.g. around 3.5 degrees.

42. A kit of part comprising:

a putter head (10, 110) according to any of items 1-16, a hosel;

a putter shaft for connecting to the hosel; and one or more weights for attachment to the rear part of the putter head.

REFERENCE NUMERALS

1 Putter
5 putter shaft
10, 110 Putter head
11, 111 heel end
12, 112 toe end
20, 120 Front part
21, 121 Putting face
22, 122 slot
23, 123 rear surface of front part
24, 124 hosel connecting means/bores
25, 125 top surface
26 hosel connecting means/rear slot
27, 127 alignment means
30, 130 rear part
31, 131 upward facing surface
32, 132 weight connecting means for weight(s)
133 protrusion/raised part on rear part
40, 140 hosel
41, 141 bore for attaching putter shaft to hosel
42, 142 first threaded bore of hosel
43, 143 second threaded bore of hosel
144 Bore in hosel
50, 150 heel weight
51, 151 front facing surface
52, 152 top surface
53, 153 bore
54, 154 heel end
55, 155 toe end
156 recess
60, 160 toe weight
61, 161 front facing surface
62, 162 top surface
63, 163 bore
64, 164 heel end
65, 165 toe end
166 recess

The invention claimed is:

1. A putter head (10, 110) for a putter (1), wherein the putter head (10, 110) comprises:

a forwardly facing putting face (21, 121) extending in a longitudinal direction between a heel end (11, 111) and a toe end (12, 112);

rearwardly a front part (20, 120); and a rear part (30, 130) extending from the front part (20, 120), wherein the front part (20, 120) comprises:

a forward-facing surface including the forwardly facing putting face (21, 121);

a rearward-facing surface (23, 123) extending from the heel end (11, 111) to the toe end (12, 112); and a slot (22, 122) provided in an upwardly facing surface of the front part (20, 120) between the forward-facing surface and the rearward-facing surface (23, 123), wherein the slot (22, 122) is configured for accepting a hosel (40, 140) for connecting a shaft (5) to the putter head (10, 110), and wherein the slot (22, 122) is further configured to arrange the hosel (40, 140) at different longitudinal positions between the heel end (11, 111) and the toe end (12, 112) of the putter head (10, 110), wherein the slot (22, 122) comprises a bottom surface, wherein the rear part (30, 130) comprises:

an upward-facing surface (31, 131) comprising weight connecting means (32, 132) thereon for connecting one or more weights (50, 150; 60, 160) to the rear part (30, 130) of the putter head (10, 110), wherein the weight connecting means (32, 132) are configured to arrange the one or more weights (50, 150; 60, 160) at different predetermined longitudinal positions between the heel end (11, 111) and the toe end (12, 112) of the putter head (10, 110) on the upward-facing surface (31, 131) of the rear part (30, 130), and wherein the putter head further includes hosel connecting means for connecting the hosel to the putter head within the slot (22, 122).

2. The putter head according to claim 1, wherein the hosel connecting means for connecting the hosel to the putter head within the slot (22, 122) is provided in the bottom surface of the slot (22, 122).

3. The putter head according to claim 1, wherein the hosel connecting means comprises a plurality of bores for inserting a screw for attaching the hosel (40, 140) to the front part (20, 120) of the putter head (10, 110).

4. The putter head according to claim 1, wherein the slot (22, 122) comprises corrugated sides.

5. The putter head according to claim 1, wherein the weight connecting means comprises one or more threaded bores in the rear part (30, 130) of the putter head (10, 110).

6. The putter head according to claim 1, wherein the rear part (30, 130) comprises a protruding part (133) extending along the longitudinal direction of the putter head (10, 110).

7. The putter head according to claim 6, wherein the weight connecting means (32, 132) are provided in the protruding part (133).

8. A putter (1) comprising:

a putter head (10, 110) according to claim 1;

a hosel (40, 140) arranged within the slot (22, 122) of the front part (20, 120) of the putter head (10, 110) and connected to the slot (22, 122) via the hosel connecting means (24);

a putter shaft (5) connected to the hosel (40, 140); and one or more weights (50, 150; 60, 160) connected to the rear part (30, 130) of the putter head (10, 110) via the weight connecting means (32, 132).

9. The putter according to claim 8, wherein the one or more weights comprises a recess formed in a lower surface for fitting to a protrusion formed in the rear part of the putter head (10, 110).

10. The putter according to claim 8, wherein the one or more weights comprises a front-facing surface which abuts the rear surface (23, 123) of the front part (20, 120) of the putter head (10, 110).

11. The putter according to claim 8, wherein the one or more weights (50, 150; 60, 160) are formed so that a top surface of the one or more weights are substantially flush with an upwardly facing surface (25) of the front part (20, 120) of the putter head (10, 110).

12. The putter according to claim 8, wherein the one or more weights are provided with a bore.

13. The putter according to claim 12, wherein the one or more weights are attached to the weight connecting means (32, 132) of the rear part (30, 130) via one or more screws.

14. The putter (1) according to claim 8, wherein the one or more weights comprises at least a heel weight (50, 150) and a toe weight (60, 160).

15. The putter (1) according to claim 14, wherein the heel weight (50, 150) comprises a shape at a heel end that is substantially flush with a shape at the heel end (11, 111) of the front part (20, 120) of the putter head (10, 110); and/or the toe weight comprises a shape at a toe end that is substantially flush with a shape at the toe end (12, 112) of the front part (20, 120) of the putter head (10, 110).

16. The putter according to claim 8, wherein at least one of the one or more weights comprises a straight toe-facing surface and/or a straight heel-facing surface.

17. The putter (1) according to claim 8, wherein at least one of the one or more weights are tapered at a rearward-facing part of the one or more weights.

18. The putter (1) according to claim 8, wherein the hosel (40, 140) is provided with at least one bore, and wherein the hosel (40, 140) is attached in the slot (22, 122) via the at least bore to at least one threaded bore in the bottom surface of the slot (22, 122).

19. The putter (1) according to claim 8, wherein the hosel (40, 140) comprises corrugated sides for fitting to corrugated sides of the slot (22, 122).

20. A putter kit comprising:

a putter head (10, 110) according to claim 1;

a hosel;

a putter shaft for connecting to the hosel; and one or more weights for attachment to the rear part of the putter head.

21. A putter (1), comprising:

a putter head (10, 110);

a hosel (40, 140) arranged within a slot (22, 122) of a front part (20, 120) of the putter head (10, 110);

hosel connecting means (24) for connecting the hosel (40, 140) to the slot (22, 122);

a putter shaft (5) connected to the hosel (40, 140);

one or more weights (50, 150; 60, 160); and weight connecting means (32, 132) for connecting the one or more weights (50, 150; 60, 160) to a rear part (30, 130) extending rearwardly of the front part (20, 120) of the putter head (10, 110), wherein the putter head (10, 110) comprises a forwardly facing putting face (21, 121) extending in a longitudinal direction between a heel end (11, 111) and a toe end (12, 112), wherein the front part (20, 120) of the putter head (10, 110) comprises:

a forward-facing surface including the forwardly facing putting face (21, 121); and the slot (22, 122), the slot (22, 122) being provided in an upwardly facing surface of the front part (20, 120), wherein the slot (22, 122) is configured for accepting the hosel (40, 140) for connecting the shaft (5) to the putter head (10, 110), the slot (22, 122) being further configured to arrange the hosel (40, 140) at different longitudinal positions between the heel end (11, 111) and the toe end (12, 112) of the putter head (10, 110), wherein the slot (22, 122) comprises a bottom surface and a rearward-facing surface (23, 123) extending from the heel end (11, 111) to the toe end (12, 112), wherein the rear part (30, 130) comprises an upward-facing surface (31, 131) comprising the weight connecting means (32, 132) thereon, wherein the weight connecting means (32, 132) are configured to arrange the one or more weights (50, 150; 60, 160) at different predetermined longitudinal positions between the heel end (11, 111) and the toe end (12, 112) of the putter head (10, 110), and wherein the hosel (40, 140) has corrugated sides for fitting to corrugated sides of the slot (22, 122).

* * * * *